United States Patent [19]

Winand

[11] 4,107,006

[45] Aug. 15, 1978

[54] ELECTROLYSIS CELL

[75] Inventor: Rene' Fernand Paul Winand, Rixensart, Belgium

[73] Assignee: Universite' Libre de Bruxelles, Brussels, Belgium

[21] Appl. No.: 703,007

[22] Filed: Jul. 6, 1976

[30] Foreign Application Priority Data

Jul. 11, 1975 [BE] Belgium ..... 831295

[51] Int. Cl.[2] ..... C25C 1/10; C25C 7/00; C25C 7/04

[52] U.S. Cl. ..... 204/105 M; 204/1 R; 204/151; 204/252; 204/255; 204/263

[58] Field of Search ..... 204/1 R, 130, 149, 151, 204/180 P, 96, 285, 105 M, 252, 255, 263

[56] References Cited

U.S. PATENT DOCUMENTS

| | | | |
|---|---|---|---|
| 883,170 | 3/1908 | Christy | 204/294 X |
| 3,006,826 | 10/1961 | Roller | 204/96 |
| 3,278,410 | 10/1966 | Nelson | 204/285 |
| 3,716,459 | 2/1973 | Salter et al. | 204/1 R |
| 3,755,114 | 8/1973 | Tarjanyi et al. | 204/149 X |
| 3,764,499 | 10/1973 | Okubo et al. | 204/151 |
| 3,945,892 | 3/1976 | James et al. | 204/1 R |
| 3,969,201 | 7/1976 | Oloman et al. | 204/1 R X |

*Primary Examiner*—Arthur C. Prescott

*Attorney, Agent, or Firm*—Scully, Scott, Murphy & Presser

[57] ABSTRACT

There is described an electrolysis cell which comprises an anode formed by said solid material which contacts directly an anode current supply made of a substantially inert material, said cell being divided into at least one anode compartment and at least one cathode compartment by means allowing the flow of the electrolyte from the cathode compartment to the anode compartment but which however prevent the passage of said solid material from one compartment to another one, other means being provided to cause a substantially continuous flow of electrolyte from the cathode compartment to the anode compartment.

12 Claims, 4 Drawing Figures

ELECTROLYSIS CELL

This invention relates to an electrolysis cell for treating inside the anode compartment, a divided solid reactant, notably a powdered or fragmented material, particularly for elaborating manganese metal from ferromanganese.

The object of this invention is essentially to provide an electrolysis cell which can be used in a method comprising besides an electrolysis, also pretreatment steps for the products taking part in the electrolysis.

The cell according to the invention allows to perform some at least of said pretreatment steps inside the cell proper.

For this purpose according to the invention, the electrolysis cell comprises an anode formed by said material which contacts directly an anode current supply made of a substantially inert material, said cell being divided into at least one anode compartment and at least one cathode compartment by means allowing the flow of the electrolyte from the cathode compartment to the anode compartment but which however prevent the passage of said solid material from one compartment to another one, other means being provided to cause a substantially continuous flow of electrolyte from the cathode compartment to the anode compartment.

In a first embodiment of the invention, the cell comprises a diaphragm which is mounted between the anode compartment and the cathode compartment.

In another embodiment of the invention, the anode compartment is bounded by the walls of a container one side wall of which is perforated and made from an electricity-conducting material, said wall being connected to an anode supply and being electrically insulated from the cathode compartment, said container being so arranged as to be able to contain said solid material to be treated.

This invention also relates to a particular application of such an electrolysis cell for elaborating manganese metal from ferromanganese.

In a first embodiment of said application method, to the anode compartment is fed the solid phase from the attack of ferromanganese by iron chloride in molten chlorides and to the cathode compartment is fed the electrolyte formed by the liquid phase from said attack in a molten chloride bath, said liquid phase having been subjected thereafter to purifying with an excess ferromanganese to remove the unreacted iron chloride, manganese-poor electrolyte loaded back with iron chloride being extracted from the anode compartment while manganese metal settling on the cathode is extracted from the cathode compartment.

In another embodiment of this application of the electrolysis cell for elaborating manganese metal from ferromanganese, the ferromanganese is directly fed to the anode compartment and to the cathode compartment is fed an electrolyte from the anode compartment which is purified from iron chloride with an excess ferromanganese, electrolyte containing manganese chloride and iron chloride being extracted from the anode compartment and subjected to said purifying operation to remove the iron chloride which allows to feed it back to the cathode compartment, manganese metal settling on the cathode being extracted from the cathode compartment.

Other details and features of the invention will stand out from the description given below by way of non limitative example and with reference to the accompanying drawings, in which.

In the various figures, the same reference numerals pertain to similar elements.

The electrolysis cell according to the invention is to be used for treating at the one electrode thereof at least, a solid material which should not contact the other electrode.

For this purpose the cell is divided into at least one anode compartment 1 and at least one cathode compartment 2 by means letting the electrolyte flow from one compartment to the other but which on the other hand prevent the solid material passing from one compartment to the other.

Figure 1:
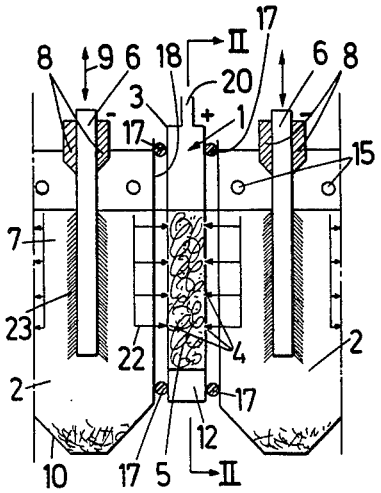
FIG. 1 is a diagrammatic cross-section along line I—I in FIG. 2 of part of a first embodiment of an electrolysis cell according to the invention.
Figure 2:
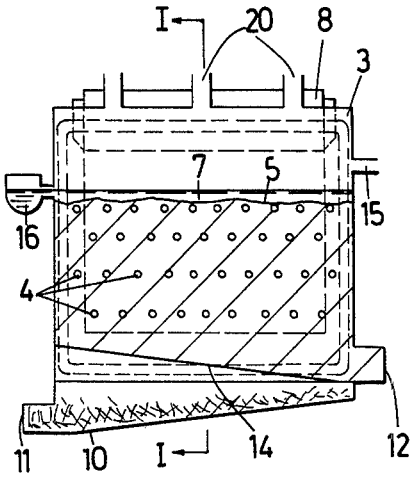
FIG. 2 is a cross-section along line II—II in FIG. 1.

In the embodiment shown in FIGS. 1 and 2, the cell comprises a plurality of anode and cathode compartments arranged side-by-side. Each anode compartment is bounded by the walls of a container 3 the side walls of which are provided with holes 4. Said walls are made from carbon, graphite or some electricity-conducting material which is nobler than the residues of the material to be recovered from the anode compartment after electrolyzing. The container 3 is so arranged as to contain the solid material 5 to be treated during the electrolysis and it is provided therefore with an inlet opening 20.

The container 3 thus forms actually a hollow anode with holes 4 therethrough.

Each cathode 6 is so mounted as to dip in the electrolyte 7 and it co-operates with scraping members 8 allowing to remove the deposits formed on the surfaces thereof.

Said cathode 6 is comprised of a plate that dips partly at least in the electrolyte 7. The scraping members 8 are formed by fixed knives located on either side of said plate above the electrolyte level and said knives are pushed against said plate, said plate being so mounted as to be movable substantially vertically as shown by arrows 9 out of the electrolyte to thus let the knives 8 scrape the deposits formed on the plate. The cathodes 6 are comprised of thick plates from steel or some other electricity-conducting material which is mechanically strong and nobler than the metal settling thereon.

By means of said scraping, the deposits formed on the cathode fall at the bottom of the cathode compartment from which they can be discharged.

The bottom 10 of cathode compartment 2 is funnel-shaped and slants along a particular direction, while the bottom 14 of the anode compartment or in the present case the bottom of container 3 slants along the opposite direction.

A discharge opening 11 is provided in the lowermost portion of the cathode compartment for discharging the deposits formed on said bottom by means of a suitable device (not shown), a similar discharge opening 12 being provided in the lowermost portion of the bottom of container 3 for the discharge of the solid residues formed in anode compartment 1.

Each cathode compartment 2 has an inlet 15 for the electrolyte that lies above the electrolyte level inside said compartment, while the anode compartment has an outlet 16 that lies substantially at the same level as the electrolyte inside said compartment. Consequently, an electrolyte flow is obtained from the cathode compartment to the anode compartment.

The anode compartment 1 and cathode compartment 2 lie next to one another and in such a way as to obtain an alternating sequence of anode compartments and cathode compartments. The cathode compartments are electrically insulated from the cathode compartments by sealing gaskets 17, the unit formed by said compartments being surrounded by an insulating refractory wall and possibly by a heating device not shown in the figures.

The cathode compartments 2 are comprised of tanks 18 joined to the anode compartments and apertured on the side of said anode compartments, so as to let the electrolyte flow from one compartment to another.

Figure 3:
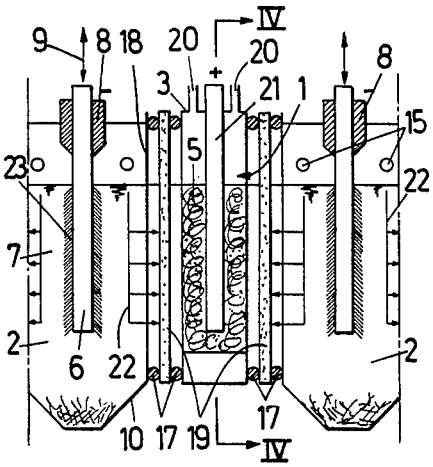
FIG. 3 is a diagrammatic cross-section along line III—III in FIG. 4, of part of a second embodiment of the cell according to the invention.
Figure 4:
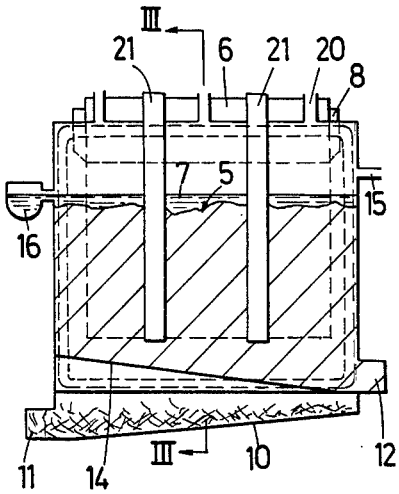
FIG. 4 is a cross-section along line IV—IV in FIG. 3.

FIGS. 3 and 4 show another embodiment of the electrolysis cell according to the invention.

Said cell differs from the cell shown in FIGS. 1 and 2 essentially because the anode compartments 1 and the cathode compartments 2 are separated by diaphragms 19 with such a design that they let the electrolyte through but retain the solid particles. The diaphragms 19 are comprised of a non-conducting porous material which is strong enough, or of a conducting material nobler than the residue from the solid material 5 fed to the anode compartments 1.

Each anode compartment 1 has in the top portion thereof above the electrolyte level, an inlet opening 20 to let said solid material enter said compartment.

On the other hand, carbon or graphite bars 21 used to supply the anode current to said solid material, are so mounted inside the anode compartments as to contact said solid material.

The cathode compartment has a structure similar to the one of the cathode compartment shown in FIGS. 1 and 2.

The sealing as well as the electric insulation between the anode and cathode compartments is insured with gaskets 17 arranged on either side of the edges of diaphragms 19.

In the same way as in the embodiment shown in FIGS. 1 and 2, the electrolysis cell according to the embodiment shown in FIGS. 3 and 4 may be comprised of an alternating sequence of anode and cathode compartments, the whole unit being surrounded by an insulating refractory wall and possibly by a heating device.

As already mentioned above, the cell according to the invention is more particularly suitable for elaborating manganese metal from ferromanganese, particularly for the working of the method for elaborating manganese metal from ferromanganese which is the object of Belgian patent application PV No. 0/156765 filed May 27, 1975.

In a first way for using the electrolysis cell according to the invention, to anode compartment 1 is fed the solid phase from the attack of ferromanganese with iron chloride in a molten salt bath and to cathode compartment 2 is fed an electrolyte 7 formed by the liquid phase from said attack which has previously been subjected to purifying with an excess ferromanganese to remove the unreacted iron chloride. Said solid phase is thus fed through openings 20 to the anode compartment while said liquid phase is fed to the cathode compartment through openings 15. The electrolyte flows through the cathode compartment to enter the anode compartment either through the holes 4 if use is made of an electrolysis cell according to the embodiment shown in FIGS. 1 and 2; or through diaphragm 19 if use is made of a cell according to an embodiment as shown in FIGS. 3 and 4. Thereafter said electrolyte which has become manganese-poor during the electrolysis but is loaded again with iron chloride, is removed from the anode compartment through outlets 16.

A deposit of dendritic or powdered manganese 23 is formed on the cathode due to the electrolysis and due to the scraping obtained by means of the vertical displacement thereof, this deposit is released and settles on the slanting bottom 10 to be collected adjacent the outlet 11 from which the deposit can be discharged with a suitable device.

In another embodiment of the method according to Belgian patent application PV No. 0/156765, to the anode compartment is directly fed through the openings 20, the ferromanganese and to cathode compartment 2 is fed through the openings 15, an electrolyte from the anode compartment and formed by a molten chloride bath containing manganese chloride and which has first been purified from the iron chloride with an excess ferromanganese. Said electrolyte flows through the cathode compartment to enter the anode compartment and to be extracted after spending thereof, from said compartment. The spent electrolyte contains manganese chloride and iron chloride which is then subjected outside the cell or inside thereof, to a purification by adding an excess ferromanganese to remove the iron chloride, the thus-purified electrolyte being fed back to the cathode compartment through the openings 15. During the electrolysis, manganese settles on the cathode and is extracted from the cell in the above-described way.

To allow the working with the method according to Belgian patent application PV No. 0/156765, use is made of cathodes which are made from thick plate of steel or some other electricity-conducting material which is mechanically strong and nobler than manganese, while use is made for the anode of carbon, graphite or another electricity-conducting material which is nobler than iron.

If an electrolysis cell with hollow anode as shown in FIGS. 1 and 2, is used, the holes 4 provided in said anode walls have a small enough diameter for the iron or ferromanganese fed to said anode not to pass through said holes. Arrows 22 show the path followed by the electrolysis. Fresh electrolyte fed to the cathode compartment flows through the holes 4 provided in the anode and then through the iron or ferromanganese load contained therein towards the outlet opening 16.

The electrolysis cell according to the invention allows to work advantageously in a completely continuous way the method according to Belgian patent application PV No. 0/156765.

It must be understood that the invention is in no way limited to the above embodiments and that many changes can be brought therein without departing from the scope of the invention as defined by the appended claims.

For instance the electrolysis cell according to the invention may be applied to other arts than the elaboration of manganese metal from ferromanganese.

I claim:

1. An electrolysis cell for treating inside the anode compartment a divided solid reactant, notably a powdered or fragmented material, which comprises, a cathode compartment being made from a solid electrical conducting material, a container forming an anode compartment and being made from an electrical conducting material and arranged to contain the solid reactant, at least one side wall of said anode compartment being permeable to allow the flow of an electrolyte from the cathode compartment to the anode compartment but which prevents the passage of the solid material from the anode compartment to the cathode compartment, and means for causing a substantially continuous flow of electrolyte from the cathode compartment to the anode compartment.

2. Cell as defined in claim 1, which comprises a diaphragm which is mounted between the anode compartment and the cathode compartment.

3. An electrolysis cell as defined in claim 1, wherein said permeable wall is a perforated wall.

4. Cell as defined in claim 2, in which the container forms a hollow anode provided with holes.

5. Cell as defined in claim 1, in which the cathode is so mounted as to dip in the electrolyte and cooperates with scraping means allowing to remove the deposits formed on the cathode.

6. Cell as defined in claim 5, in which the cathode is comprised of a substantially vertical plate that dips partly at least in the electrolyte, the scraping means comprising fixed knives arranged on either side of said plate above the electrolyte level and applied against said plate, said plate being so mounted as to be movable substantially vertically outside of the electrolyte thus causing the scraping of the deposits formed on the plate.

7. Cell as defined in claim 1, in which each compartment has a slanting bottom allowing to discharge the solid deposits recovered on the respective bottoms.

8. Cell as defined in claim 1, in which the cathode compartment and the anode compartment lie next to one another.

9. Cell as defined in claim 8, in which the cathode compartment is comprised of a tank tightly joined to the anode compartment and apertured on the anode compartment side to let the electrolyte pass from one compartment to another.

10. Cell as defined in claim 8, which comprises an alternating sequence of anode compartments and cathode compartments.

11. Method for using an electrolysis cell as defined in claim 1 for elaborating manganese metal from ferromanganese, in which to the anode compartment is fed the solid phase from the attack of ferromanganese by iron chloride in molten chlorides and to the cathode compartment is fed the electrolyte formed by the liquid phase from said attack in a molten chloride bath, said liquid phase having been subjected thereafter to purifying with an excess ferromanganese to remove the unreacted iron chloride, manganese-poor electrolyte loaded back with iron chloride being extracted from the anode compartment while manganese metal settling on the cathode is extracted from the cathode compartment.

12. Method for using an electrolysis cell as defined in claim 1, for elaborating manganese metal from ferromanganese, in which the ferromanganese is directly fed to the anode compartment and to the cathode compartment is fed an electrolyte from the anode compartment which is purified from iron chloride with an excess ferromanganese, electrolyte containing manganese chloride and iron chloride being extracted from the anode compartment and subjected to said purifying operation to remove the iron chloride which allows to feed it back to the cathode compartment, manganese metal settling on the cathode being extracted from the cathode compartment.

* * * * *

UNITED STATES PATENT AND TRADEMARK OFFICE

CERTIFICATE OF CORRECTION

PATENT NO. : 4,107,006

DATED : August 15, 1978

INVENTOR(S) : Rene Fernand Paul Winand

It is certified that error appears in the above-identified patent and that said Letters Patent are hereby corrected as shown below:

Column 5, line 1, delete "compartment".

Signed and Sealed this

*Twelfth* Day of *February 1980*

[SEAL]

*Attest:*

SIDNEY A. DIAMOND

*Attesting Officer*

*Commissioner of Patents and Trademarks*